United States Patent [19]

Tomisawa et al.

[11] 4,033,221

[45] July 5, 1977

[54] KEY SWITCH SYSTEM

[75] Inventors: Norio Tomisawa, Hamamatsu; Yasuji Uchiyama, Hamakita; Takatoshi Okumura; Toshio Takeda, both of Hamamatsu, all of Japan

[73] Assignee: Nippon Gakki Seizo Kabushiki Kaisha, Hamamatsu, Japan

[22] Filed: Aug. 11, 1975

[21] Appl. No.: 602,631

[30] Foreign Application Priority Data

Aug. 12, 1974 Japan ..... 49-92173

[52] U.S. Cl. ..... 84/1.03

[51] Int. Cl.[2] ..... G10F 1/00

[58] Field of Search ..... 84/1.01, 1.03, 1.09–1.11, 84/1.13, 1.22–1.28

[56] References Cited

UNITED STATES PATENTS

| | | | |
|---|---|---|---|
| 3,610,799 | 10/1971 | Watson | 84/1.26 |
| 3,696,201 | 10/1972 | Arsem et al. | 84/1.03 |
| 3,746,773 | 7/1973 | Uetrecht | 84/1.01 |
| 3,871,247 | 3/1975 | Bonham | 84/1.16 |
| 3,882,751 | 5/1975 | Tomisawa et al. | 84/1.11 |
| 3,890,871 | 6/1975 | Oberheim | 84/1.03 |
| 3,899,951 | 8/1975 | Griffith | 84/1.03 |

*Primary Examiner*—James R. Scott
*Assistant Examiner*—Vit W. Miska
*Attorney, Agent, or Firm*—Howard A. Silber

[57] ABSTRACT

This key switch system (1) scans closed (or open) key switches in a matrix to produce corresponding key data, (2) encodes these key data into corresponding key codes, and (3) effectively registers the encoded key codes into time-shared channels of a key code memory.

The key switch system may be incorporated in an electronic musical instrument. The system includes a key data generator which produces block data consisting of one pulse per scanning cycle in a time slot representing a block to which a key switch which is ON belongs, and note data consisting of a pulse in a time slot representing the particular key switch which is ON in the block indicated by the block data. A key coder encodes the block data and note data supplied from the data generator into key codes each representing the key name of the depressed key. A channel processor allots the key codes to storage channels of a key code memory having a number of such channels equal to the maximum number of tones to be reproduced simultaneously.

7 Claims, 8 Drawing Figures

BLOCK MEMORY
BLOCK READ-OUT
SCANNED OUTPUT
BD
BDO (k)
LD
Sy 0

N1 N2 N3 N4 B1 B2 B3 B4
MKC
KEY CODE MEMORY
S/R (12/8)
STAGES
BITS
RETURN GATE
ENTRANCE GATE
RKC
IKC
KC
89
89a
89b
S/R (1/4)
NC
BC
SAMPLE HOLD
SYO (CLEAR)
NC*
BC*
KC*
SELF HOLD
SYO (CLEAR)
GATE
BINARY CODE (4 BITS)
COUNTER
S/R (12/1)
φ (1μs)
φ (12μs)
SYO (192μs)
ta
tb
BD
ND
IDENTITY
SELF HOLD
SAMPLE HOLD
REG.
φ (CLEAR)
EMPTY
REGISTERED
S/R (1/1)
KD

KEY SWITCH SYSTEM

BACKGROUND OF THE INVENTION

This invention relates to a key switch system capable of scanning closed (or open) key switches very rapidly to produce corresponding key data, encoding the key data into corresponding key codes, and effectively registering the encoded key codes in time-shared channels of a key code memory.

In a case wherein ON (or OFF) information of key switches in an apparatus containing a large number of key switches such as a keyboard of an electronic musical instrument is to be transferred to a utilization circuit, complicated wiring is required. Therefore, it is uneconomical if these switches are connected to the circuit by individual connecting lines. Such method also is disadvantageous in that it cannot be used in a semiconductor integrated circuit in which the number of connecting pins is limited. As a result, an apparatus using such method tends to be bulky.

With a view to eliminating the above-described difficulties, the applicant has proposed in their U.S. Pat. No. 3,882,751 a system according to which all switches are sequentially scanned at a predetermined rate and a pulse is produced in a time slot corresponding to a switch which is ON. This system successfully eliminates a large number of connecting lines between the key switches and a circuit to which key switch signals are transferred. Such a system, however, requires a fixed period of time for scanning all of the key switches. As a result, an undesireable time lag tends to be produced between actuation of the switches and detection of such actuation. Furthermore, in such a system, the fixed scanning duration is wasteful of time in a case wherein a relatively small number of switches are ON. If scanning of each switch requires, for example, 12 $\mu$s, the total time required for scanning all key switches is 12 $\mu$s $\times$ 256 = 3 ms. If a certain key switch is closed immediately after it has been scanned, there occurs delay of approximately 3 ms before the ON state of that key switch is detected by subsequent scanning. Furthermore, if only one switch is ON, the time of about 3 ms is wasted in one scanning cycle.

Another aspect to be considered in a construction of an electronic musical instrument is an arrangement for simultaneously reproducing a plurality of musical tones. Tone reproducing channels corresponding in a number to the maximum number of tones to be reproduced simultaneously must be provided, and a signal designating the tone selected key must be assigned to one of these channels.

Various proposals have been made in the past as to circuitry for assigning the signal to a suitable channel (e.g. U.S. Pat. No. 3,882,751 owned by the same applicant). In these proposals, an ON (or OFF) state of a key switch is detected by presence (or absence) of a pulse in a particular time slot, and each key switch individually possesses its own time slot. Accordingly, in order to store information of a depressed key in a certain allotted channel of a memory, it is necessary to measure the time from a certain reference time until occurrance of a time slot in which a pulse corresponding to the depressed key exists, and to cause the memory to store information representing this measured time. For example, time slots are sequentially counted by a timing counter from the reference time point and until occurrance of the depressed key pulse, and the resulting count, indicative of the measured time and hence indicative of the selected key, is stored in a memory. Accordingly, no key assignment is conducted for a time slot in which no pulse is present.

A keyboard of an electronic musical instrument generally has a large number of keys among which only a small number of keys are simultaneously depressed. In other words, the number of time slots in which no pulse is present is much larger than the number of time slots in which a pulse is present. Accordingly, time actually spent for the key assigning operation is only a small portion of the entire scanning time, the rest of the scanning time being wasted without any key assigning operation. Alternatively stated, only a small portion of time is allotted for actual key assigning operation due to this wasted portion of time with a result that difficulties arise in the circuit design since sufficiently ample operation time is not available.

SUMMARY OF THE INVENTION

It, is therefore, an object of the invention to provide a key switch system capable of producing key data corresponding to a key switch or key switches which are ON without a time loss by variably adjusting an entire scanning time required for detecting states of all of the key switches in accordance with states of key switches which are ON.

It is another object of the invention to provide a key switch system capable of encoding the key data into a corresponding key code and effectively allotting the encoded key code to one of a plural time-shared channels of a memory in accordance with the contents of the key code.

These and other objects and features of the invention will become apparent from the description made hereinbelow with reference to the accompanying drawings.

DETAILED DESCRIPTION OF THE INVENTION

Figure 1:
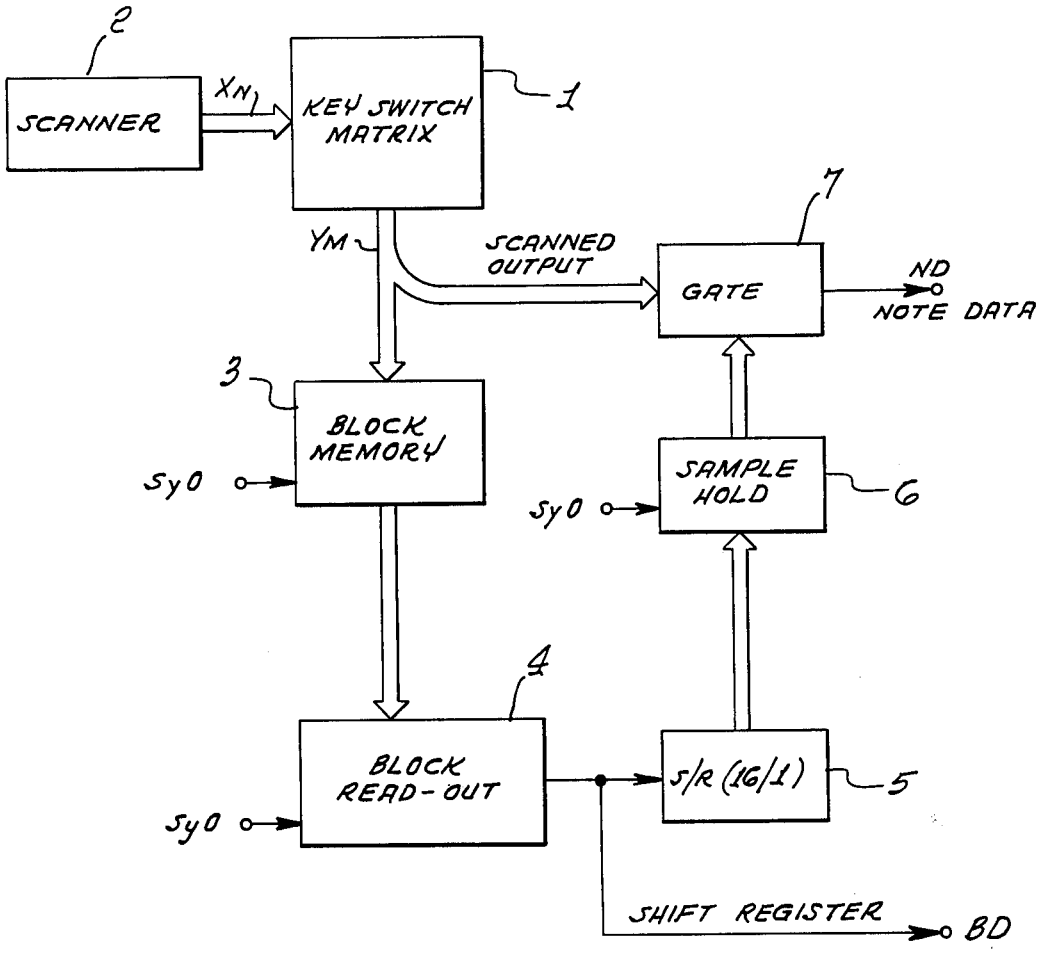
FIG. 1 is a block diagram showing a preferred example of a key data generator incorporated in the key switch system according to the invention.

Referring to FIG. 1, N(a plural number) scanning lines $X_N$ and M(a plural number) output lines $Y_M$ are respectively connected to each other through key switches in a key switch matrix 1. The maximum number of key switches arranged in the key switch matrix is N $\times$ M. Each of the key switches is driven by one of the keys arranged in the keyboard. Each of the output lines $Y_M$ corresponds to a particular block of N key switches connected to one output line belonging to that block. Accordingly, all of the switches are divided into M blocks by the output lines $Y_M$, each block including N key switches. There may, however, be a line which has no key switch at all on it, if provision of such switches is unnecessary.

A signal "1" is provided by a scanner 2 sequentially on each line 1 through N of the scanning lines $X_N$ to scan all the switches of the respective blocks on one scanning line simultaneously, thus sequentially scanning N key switches on each of the output lines $Y_M$. The scanner 2 is composed of a shift register or a counter and provides a signal "1" sequentially and cyclically on the scanning lines 1 – N at a predetermined scanning rate. If a scanning rate for detecting one scanning line is represented by $\phi$ ($\mu$s), the time required for one scanning cycle (i.e. scanning of all of the scanning lines 1 – N) is $N \times \phi$ ($\mu$s). This time is hereinafter referred to as one block time period.

Operations of component parts of the key data generator are synchronized with each other by means of a synchronizing pulse $S_yO$ which has a pulse width of $\phi$ ($\mu$s) and is produced at the beginning of each scanning cycle with a pulse interval of $N \times \phi$ ($\mu$s).

If a certain key switch is ON in a certain block, a pulse output is produced on the output line $Y_M$ corresponding to this block. A block memory 3 temporarily stores a signal "1" in response to this output pulse when at least one switch is ON in the particular block. Each block has its temporary storage section in the block memory 3 and pulses are stored block by block in response to signals provided on the output lines $Y_M$. The contents of the block memory 3 are rewritten by the synchronizing signal $S_yO$ every scanning cycle.

A block read-out unit 4 is provided for sequentially reading out the signals representing the respective blocks stored in the block memory 3. The contents of the block memory 3 are transferred simultaneously to cascade-connected stages of a shift register in the bock read-out unit 4 by a load signal to be described later upon application of each synchronizing pulse $S_yO$ and the contents of each stage of the shift register are shifted by a clock $\phi$. One cycle of circulation of this shift register is synchronized with one scanning cycle and, by sequential shifting of the stored contents, a predetermined time slot assigned for the particular block is selected during one cycle of circulation. Accordingly, a pulse is produced in the time slot corresponding to the block at which a signal "1" is produced.

The block read-out unit 4 further comprises a read-out and sorting circuit for producing only one pulse in a time slot corresponding to the block of the first pulse among a plurality of pulses arriving during one cycle of circulation and feeding this sole pulse to a shift register 5, while feeding back succeeding pulse signals corresponding to the rest of the blocks to the shift register of the read-out unit 4 during this cycle. Accordingly, only one pulse corresponding to one block stored in the block memory 3 is read out in one cycle of circulation and a first incoming pulse among the pulses corresponding to the rest of blocks is read out in the next cycle of circulation. In this manner, a single stored block signal is read out every cycle of circulation (i.e., during each time period $S_yO$) to provide a BD signal, FIG. 3 (*m*). The time slot position of this single pulse designates a block in which a switch is ON. The reading-out is completed when a number of scanning cycles corresponding to the number of the stored blocks are over.

Since the block read-out unit 4 produces a pulse designating only one block during one scanning cycle, a signal 1 is applied to the shift register 5 at a predetermined time slot corresponding to that block during one scanning cycle (one cycle of circulation). The shift register 5 is of a cascade-connected, parallel output type, each stage thereof corresponding to one of the blocks. One shift cycle in which all stages of the shift register 5 have completed shifting is synchronized with one scanning cycle. Accordingly, the stage which holds a signal 1 at the time of application of the synchronizing pulse $S_yO$ corresponds to a block read out by the block read-out unit 4. The contents of the respective stages of the shift register 5 are transferred to a sample/hold circuit 6 at application of the synchronizing pulse $S_yO$, causing a signal 1 to be held in a predetermined position corresponding to the particular block. Thus the sample hold circuit 6 produces a signal 1 only on its output line corresponding to the particular block during one scanning cycle. The outputs for the respective blocks are applied to corresponding gates of a gate circuit 7. Accordingly, only one gate corresponding to the sample-held block can be enabled.

Figure 3:
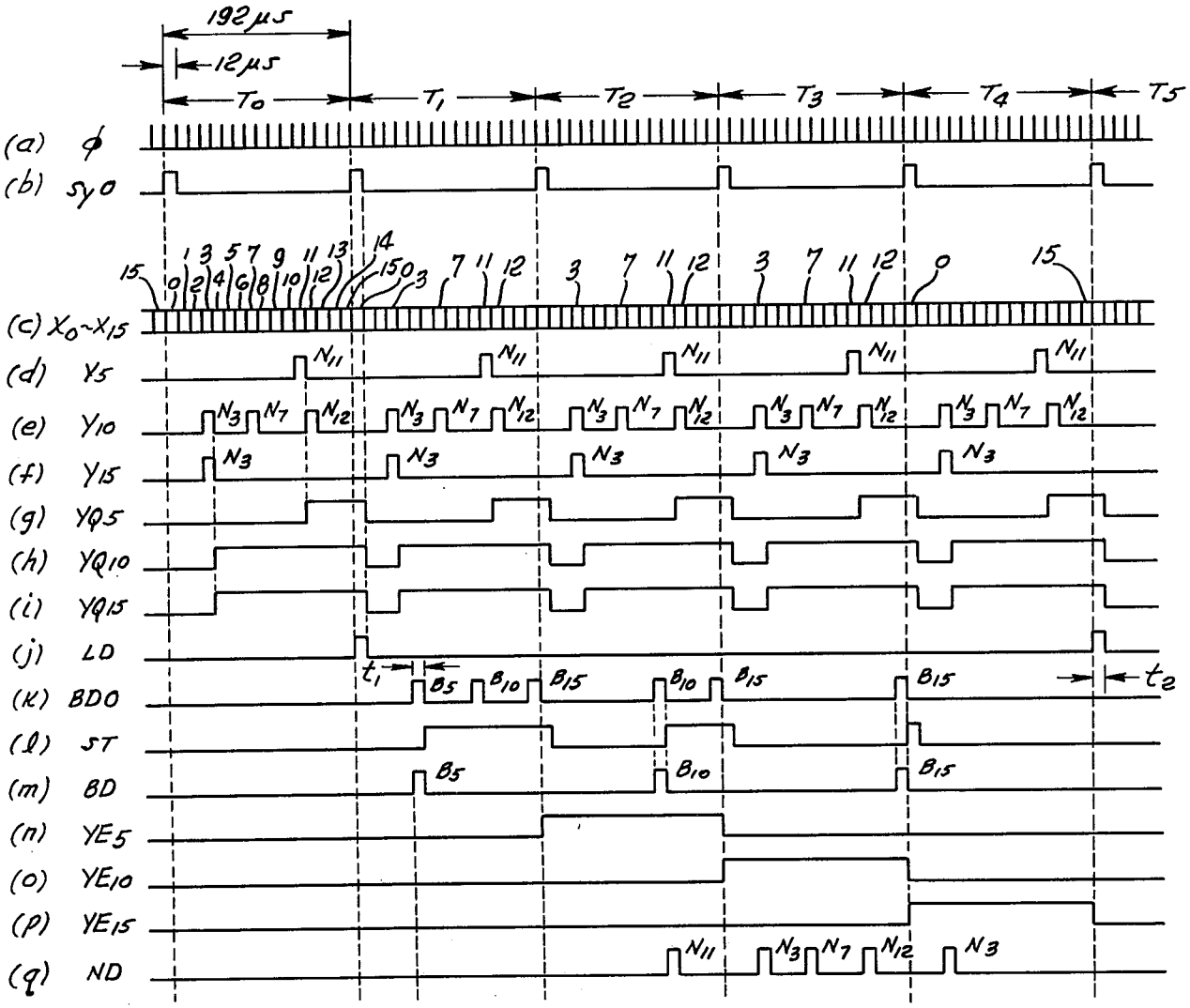
FIGS. 3(*a*) to 3(*q*) are timing charts showing relationship between signals appearing in some component parts of the key data generator shown in FIGS. 2, 4 and 5.

Each gate of the gate circuit 7 also is connected to one of the output lines $Y_M$ of the switch matrix circuit 1. When one of the gates of the gate circuit 7 corresponding to the particular block is supplied with the output of the sample hold circuit 6, signal or signals on the output line $Y_M$ corresponding to the particular block are sequentially gated out of the gate circuit 7 during one scanning cycle in response to the scanning by the scanner 2. These output signals of the gate circuit 7 indicate key switches which are ON in the particular block. Thus scanned outputs corresponding to the stages of the respective switches of the particular block are sequentially provided in the form of a pulse train. This output pulse train of the gate circuit 7 has time slots corresponding to the scanned outputs of the scanner 2 and constitute note date ND specifying switches which are ON in the particular block, as shown in FIG. 3 (*q*).

The particular block and the position of the particular switch in the particular block are specified by the combination of the block data BD and the note data ND. Thus the switch in the switch matrix circuit 1 is specified and information that the particular switch is ON (or OFF) is provided.

Operations of the component parts of the key data genertor shown in FIG. 1 will now be described with reference to FIGS. 2 – 5.

Figure 2:
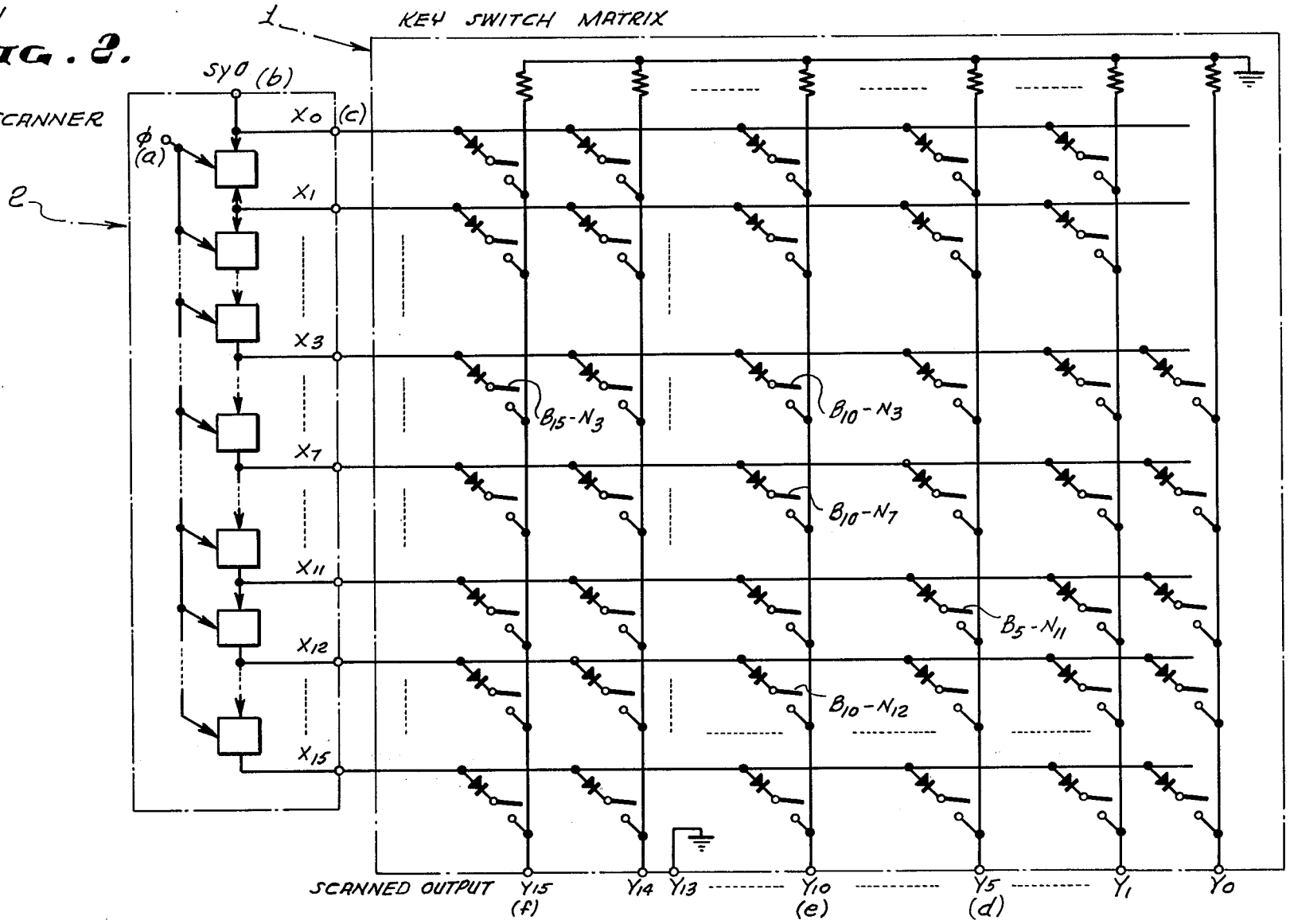
FIG. 2 is a circuit diagram showing one specific example of a key switch matrix shown in FIG. 1.

In the key switch matrix shown in FIG. 2, there are sixteen output lines $Y_0$ to $Y_{15}$ representing sixteen blocks. Sixteen key switches are provided on each of these output lines $Y_0$ to $Y_{15}$ and each of these key switches is connected to a corresponding one of scanning lines $X_0$ to $X_{15}$ through a diode. It will be noted, however, that key switches are not provided at unnecessary intersections such as ones between the output line $Y_0$ and the scanning lines $X_0$ and $X_1$. If an entire block is unnecessary, no key switches are provided on such blocks as shown by the output line $Y_{13}$. Some of the key switches are operated by the keys of the manual or pedal keyboard while others are used for tone color selection and production of various other musical tone effects.

As the scanner 2, a shift register 2′ of 15 stages is employed in the present embodiment. This shift register 2′ receives as its input the synchronizing signal $S_yO$ shown in FIG. 3(*b*) and sequentially shifts the input signl 1 upon receipt of a clock pulse $\phi$ shown in FIG. 3(*a*). When the synchronizing pulse $S_YO$ is applied to the shift register 2′, a signal 1 is produced on the scanning line $X_0$. Then a signal 1 is sequentially produced on the scanning lines $X_1 - X_{15}$ each signal existing during one period of the clock $\phi$.

Assume that a key switch $B_5 - N_{11}$ of the fifth block $B_5$ (the output line $Y_5$), key switches $B_{10} - N_3$, $B_{10} - N_7$ and $B_{10} - N_{12}$ of the tenth block $B_{10}$ (the output line $Y_{10}$) and a key switch $B_{15} - N_3$ of the fifteenth block $B_{15}$ (the output line $Y_{15}$) are closed. All of the block are simultaneously scanned and pulse outputs are produced on the output lines $Y_5$, $Y_{10}$ and $Y_{15}$ at timing relations showing in FIGS. 3(*d*) – 3(*f*) during each scanning period $T_0$, $T_1$, $T_2$ . . . These pulse outputs are applied to the block memory 3 shown in FIG. 4.

The block memory 3 has self-hold circuits $3 - B_0$ through $3 - B_{15}$ each of which is provided for holding a signal representing a corresponding block. In the figure, only the self-hold circuit $3 - B_{15}$ corresponding to the fifteenth block is illustrated in detail for convenience of description. The first pulse applied to a delay flip-flop $DF_1$ through an OR gate $OR_1$ during one scanning cycle (i.e. the period $T_0$) is delayed by the flip-flop $DF_1$ by one clock period and thereafter is fed back thereto through an AND gate $A_1$ and held therein. Taking the tenth block $B_{10}$ for example, when the first pulse $N_3$ is produced on the output line $Y_{10}$ as shown in FIG. 3(*e*), storage output $YQ_{10}$ is set a 1 with a delay of one clock period as shown in FIG. 3(*h*). The succeeding pulses $N_7$ and $N_{12}$ have no influence over the storage output $YQ_{10}$. This state which represents the fact that at least one key switch is ON in the tenth block has now been detected and stored in the self-hold circuit $3 - B_{15}$. When a synchronizing pulse $S_yO$ thereafter is applied to the AND gate $A_1$ through an inverter $I_1$, the storage output $YQ_{10}$ is cleared after delay of one clock period. Accordingly, waveshapes of storage outputs $YQ_5$, $YQ_{10}$ and $YQ_{15}$ of the blocks corresponding to the output lines $Y_5$, $Y_{10}$ and $Y_{15}$ are as shown in FIGS. 3(*g*) – 3(*i*). Storage outputs of the blocks corresponding to the other output lines are always 0.

A load signal LD as shown in FIG. 3(*j*) is produced from an AND gate 50 as a logical product of the synchronizing pulse $S_yO$ and the output of an inverter $I_2$ and is applied to each AND gate of an AND circuit 43. Accordingly, the storage outputs of the block memory 3 are written in parallel in respective stages of a shift register 41. The shift register 41 is a parallel-input-series-output type circulating shift register of 16 stages, the contents thereof being shifted by the clock $\phi$. Since the number of stages of the shift register 41 is the same as the number of the scanning lines, one cycle of circulation of the shift register 41 is in synchronization with one scanning cycle. When the storage outputs have been written in the shift register 41, contents of the shift register stages corresponding to the fifth block $B_5$, the tenth block $B_{10}$ and the fifteenth block $B_{15}$ are respectively 1. Since these contents are shifted in series by the clock $\phi$, each of the blocks is shifted sequentially and time slots specifying these blocks are established. Referring to FIG. 3(*k*), pulses are produced at predetermined time slots assigned for the blocks $B_5$, $B_{10}$ and $B_{15}$ as shown by outputs BDO of the shift register 41 during a block time period $T_1$ corresponding to one cycle of circulation (i.e. one scanning cycle immediately after writing of the storage outputs in the shift register 41.). These outputs BDO are applied to the read-out and sorting circuit 42.

The read-out and sorting circuit 42 reads out only a pulse which is produced first during one cycle of circulation and transfers this pulse to the shift register 5. Then the circuit 42 feeds back any succeeding pulses arriving from the shift register 41 during the same cycle of circulation to the shift register 41 without transferring them to the shift register 5. When a pulse corresponding to the block $B_5$ is produced from the shift register 41, an output ST of a self-holding circuit including a delay flip-flop $DF_2$ is held in the self-holding circuit as a signal 1 with a delay of one clock period and returns to a signal 0 with a delay of one clock period after a sequentially applied synchronizing pulse $S_yO$ disappears. An AND circuit $A_2$ therefore is enabled only during a period of time $t_1$, gating out only the pulse corresponding to the block $B_5$ as shown in FIG. 3(*m*). An AND circuit $A_3$ thereafter can be enabled during the rest of the block time period $T_1$ so that the pulses corresponding to the blocks $B_{10}$ and $B_{15}$ are fed back to the shift register 41 and sequentially shifted again. Similarly, a pulse corresponding to the block $B_{10}$ is read out in a block time period $T_2$ which corresponds to a next one scanning cycle and a pulse corresponding to the block $B_{15}$ is read out in a next block time period $T_3$.

As all of the pulses corresponding to the memorized blocks have been sorted out in the foregoing manner, there is no pulse arriving in the read-out and sorting circuit 42 during a next block time period $T_4$. The self-holding circuit $DF_2$ therefore is not set at 1 and the output ST produced upon application of the synchronizing pulse SyO (with a period $t_2$) during a next block time period $T_5$ is a signal 0. This signal 0 is inverted by an inverter $I_2$ and thereafter is applied to an AND circuit $A_{50}$. The AND circuit $A_{50}$ thereupon produces a pulse which is used as the load signal LD. The block time period $T_4$ during which no read-out block signal output BDO arrives in the read-out and sorting circuit 42 corresponds to the above described block time period $T_0$ and the signals $YQ_5$, $YQ_{10}$ and $YQ_{15}$ which have been stored in the block memory 3 during this block time period $T_4$ are transferred to the shift register 41 again by this load signal LD. This operation is repeated in the succeeding block time periods. Accordingly, there is a space of the block time period $T_4$ which is equal to one scanning cycle from completion of reading of a group of pulses till transfer of a next group of pulses. No data is provided and only scanning of the key switch matrix is continuted during this period of time. This period is hereinafter called a "preparatory scanning period". In FIG. 3, the block time periods $T_0$ and $T_4$ are the preparatory scanning periods.

The output of the AND circuit $A_2$ is applied as block data to the series-input-parallel-output type shift register 5 (FIG. 5) of 16 stages. The pulse corresponding to the block $B_5$ is applied to the shift register 5 during the block time period $T_1$. Then the pulse has been shifted by eleven clocks (i.e. at the time when the synchronizing pulse SyO is applied), an output of a state S5 only is a signal 1. The outputs of the respective stages of the shift register 5 are applied to the sample hold circuit 6. The sample hold circuit 6 consists of sample hold circuit portions 6 – $B_0$ to 6 –$B_{15}$ each comprising a field-effect transistor FBT and a condenser C. The field-effect transistor FBT of each circuit portion is gated by the synchronizing pulse SyO to charge the condenser C with a signal of a corresponding stage of the shift register 5. The circuit portion holds this signal until application of a next synchronizing pulse SyO. Accordingly, upon application of the synchronizing pulse SyO during the block time period $T_2$ the signal 1 of the stage S5 is loaded in the circuit portion 6 – $B_5$ assigned for the block $B_5$, and the output $YB_5$ of the circuit portion 6 – $B_5$ maintains a signal 1 during the block time period as shown in FIG. 3(*n*). Similarly, the output $YB_{10}$ corresponding to the block $B_{10}$ maintains a signal 1 during the block time period $T_3$ and the output $YB_{15}$ corresponding to the block $B_{15}$ maintains a signal 1 during the block time period $T_4$, as shown in FIGS. 3(*o*) and 3(*p*).

The outputs of the sample and hold circuit 6 are applied to a group of AND circuits generally designated by a reference numeral 71 and arranged in such a manner that each of them corresponds to one of the blocks. The AND circuits 71 are also connected to the corresponding output lines $Y_0$ – $Y_{15}$ of the key switch matrix 1. Accordingly, only one of the AND circuits 71 is enabled during one scanning cycle to select a result of scanning of the output line of the particular block. In the scanning cycle of the period $T_2$, a signal corresponding to the output line $Y_5$ shown in FIG. 3(*d*) is gated out of the AND circuit 71 and is provided through an OR circuit 72 as the note data of the block $B_5$. FIG. 3(*q*) shows that a pulse exists in a time slot of the switch $N_{11}$ which corresponds to the scanning line $X_{11}$. Similarly, one of the AND circuit 71 corresponding to the block $B_{10}$ is enabled by the output $YE_{10}$ during the period $T_3$, and a signal corresponding to the output line $Y_{10}$ is provided as the note data ND of the block $B_{10}$. In this case, pulses exist in time slots of the switches $N_3$, $N_7$ and $N_{12}$ corresponding respectively to the scanning lines $X_3$, $X_7$ and $X_{12}$. In the period $T_4$, a pulse $N_3$ of the output line $Y_{15}$ is produced as the note data ND.

In the above described embodiment, switches of three blocks ($B_5$, $B_{10}$, $B_{15}$) are closed and scanning is performed to detect only these three blocks. As to the other thirteen blocks ( 0, 1, 2, 3, 4, 6, 7, 8, 9, 11, 12, 13 and 14), no scanning time is allotted at all. If, accordingly, the period of the clock $\phi$ is 12 $\mu$s, time required for scanning one block is 12 $\mu$s × 16 = 192 $\mu$s. Time required for scanning three blocks is 192 $\mu$s × 3 = 576 $\mu$s, and a total time for scanning including the preparatory scanning time is 576 + 192 = 768 $\mu$s. It will be understood from this that scanning time is considerably saved as compared with 3 ms required by the prior art system in which all the key switches are scanned regardless of their switching states. In the inventive key switch system, if the number of blocks in which the switches are ON is smaller than the above described embodiment, the total scanning time is further shortened. It may be pointed out that the total scanning time will be prolonged if the number of blocks in which the switches are ON is relatively large. Since, however, the number of keys which can be depressed by human fingers is limited, the total scanning time cannot be prolonged to such a degree that the inventive key switch will lose its advantage, as far as key switches of electronic musical instruments are concerned.

If this key data generator is used in an electronic musical instrument, a large number of signals of special switches provided for controlling various musical tone effects such as pitches, tone colors, and volume can be transferred in the saved time. Further, a slower clock rate can be used by virtue of the saved time, whereby a semiconductor device constituting the electronic musical instrument circuitry can be made remarkably compact and manufactured at a reduced cost.

Figure 6:
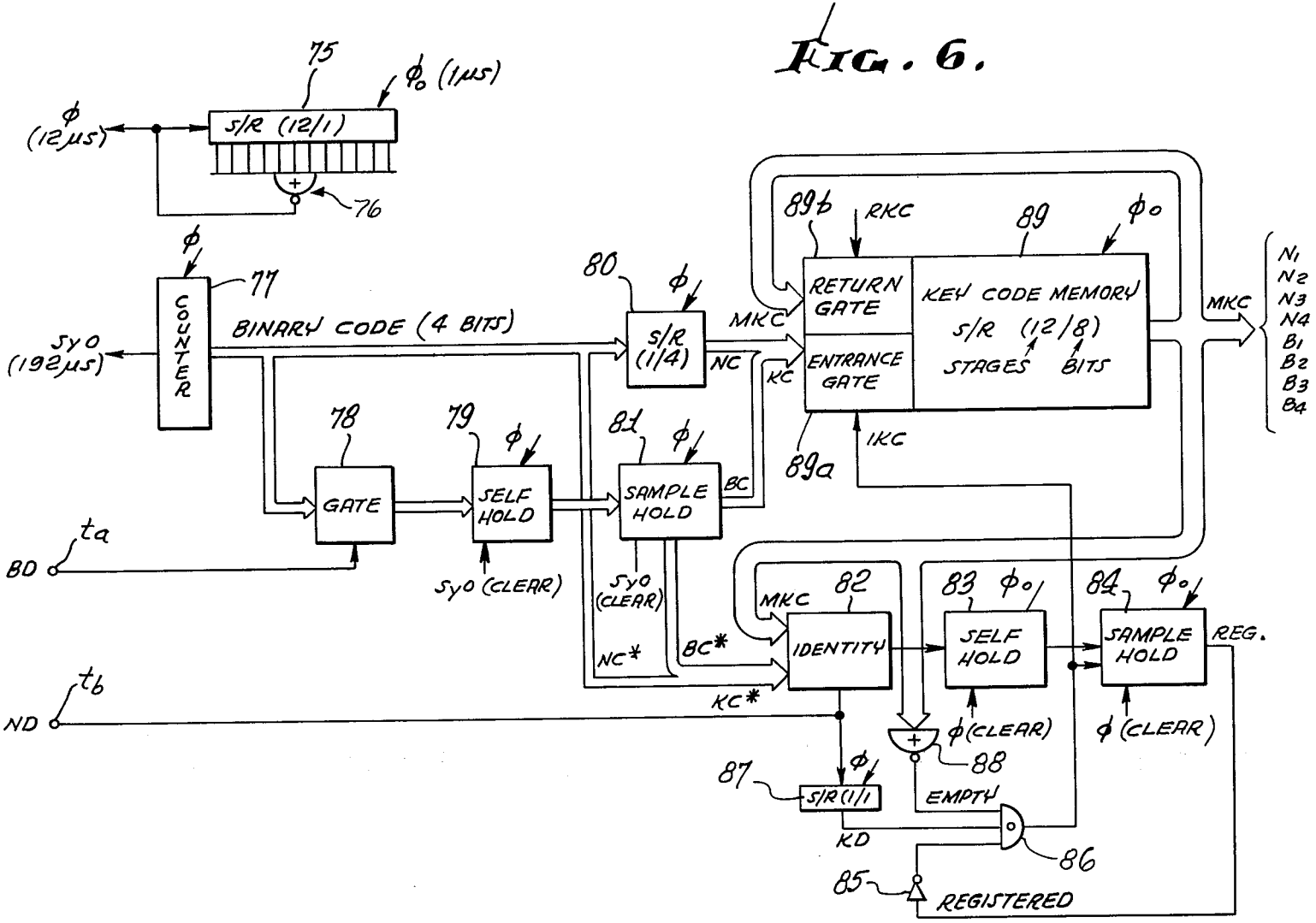
FIG. 6 is a block diagram showing a preferred example of a channel processor incorporated in the key switch system according to the invention.
Figure 7:
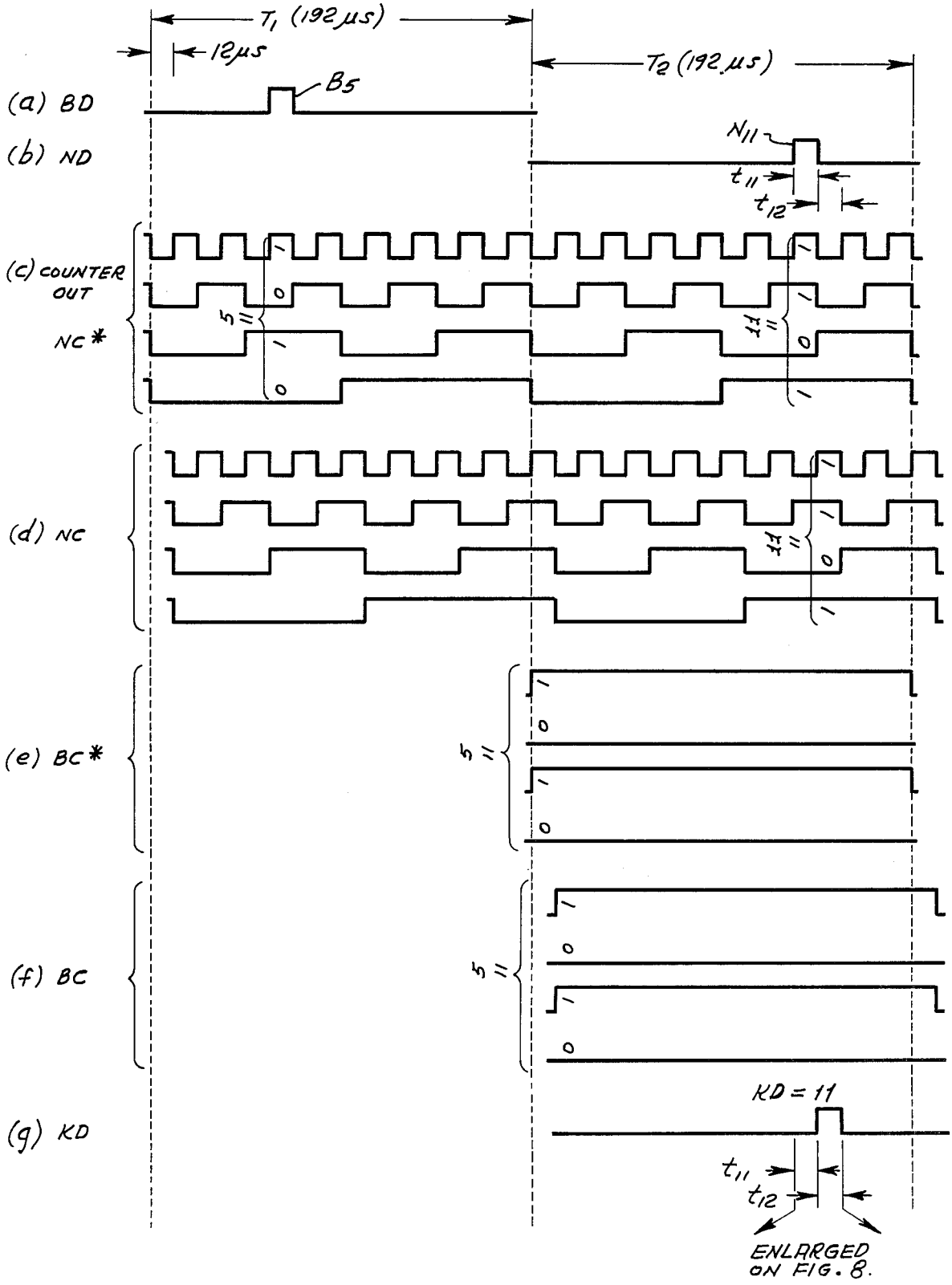
FIGS. 7 and 8 are timing charts respectively showing relationships between signals appearing in some component parts shown in FIG. 1.
Figure 8:
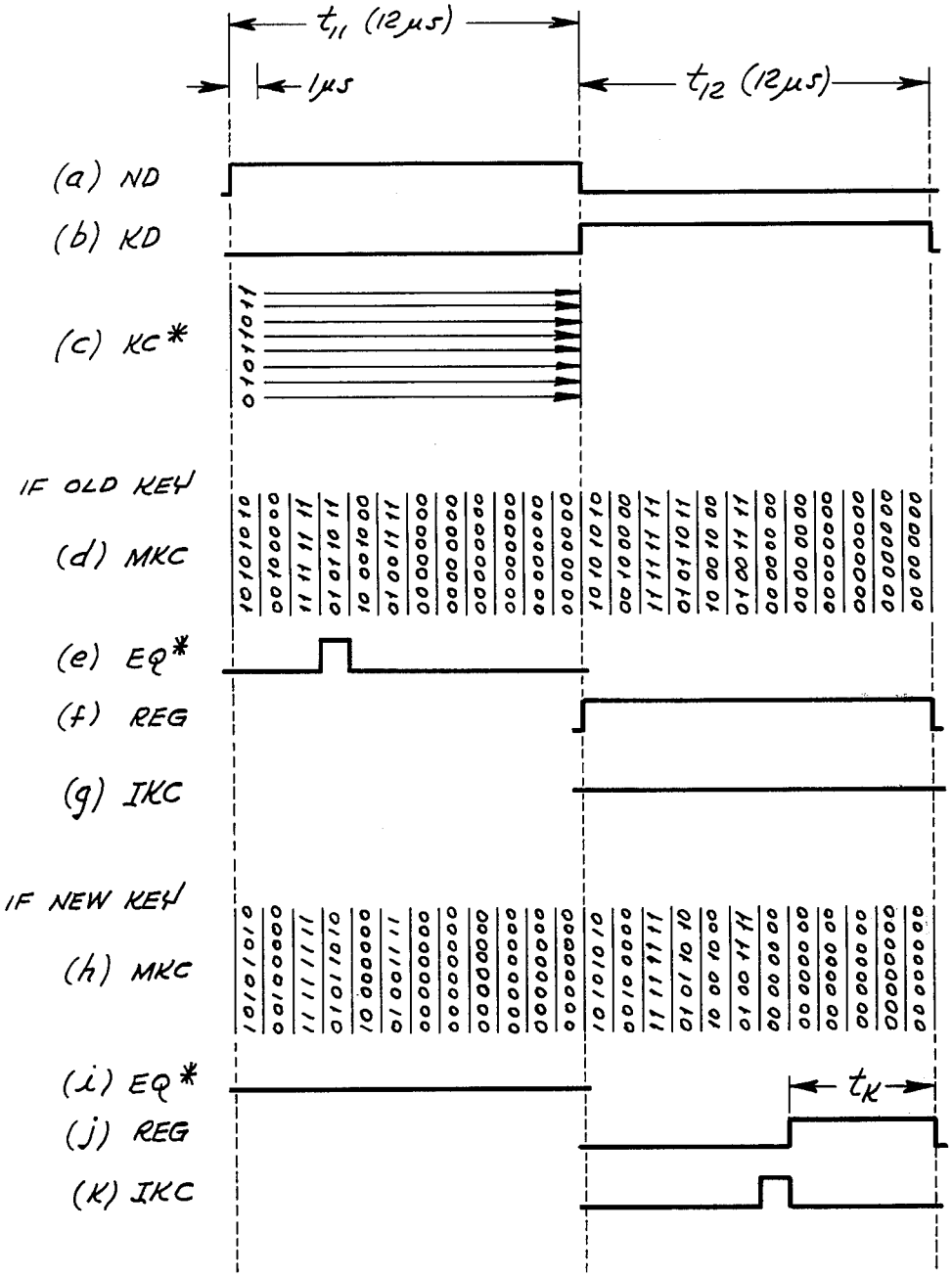

FIG. 6 – 8 show one preferred example of the key coder and the channel processor to be incorporated in the key switch system according to the invention. FIG. 6 is a block diagram showing in detail a circuit construction of the key coder and channel processor and FIGS. 7 and 8 are graphic diagrams showing states of signals in the component parts of the key coder and the channel processor.

Briefly explained, the key coder encodes block data BD and note data ND (a block to which the depressed key belongs and a note in the particular block respectively represented by particular time slot positions) into a key code representing a key name of the depressed key. The channel processor causes the key code to be stored in a key code memory (having channels of a number equal to a maximum number of musical tones to be reproduced simultaneously and a key code stored in each of the channels being used as frequency information representing a musical tone) on condition that a key code which is identical with the key code to be stored has not yet been stored in the memory and that there is at least one empty channel left available.

Figure 4:
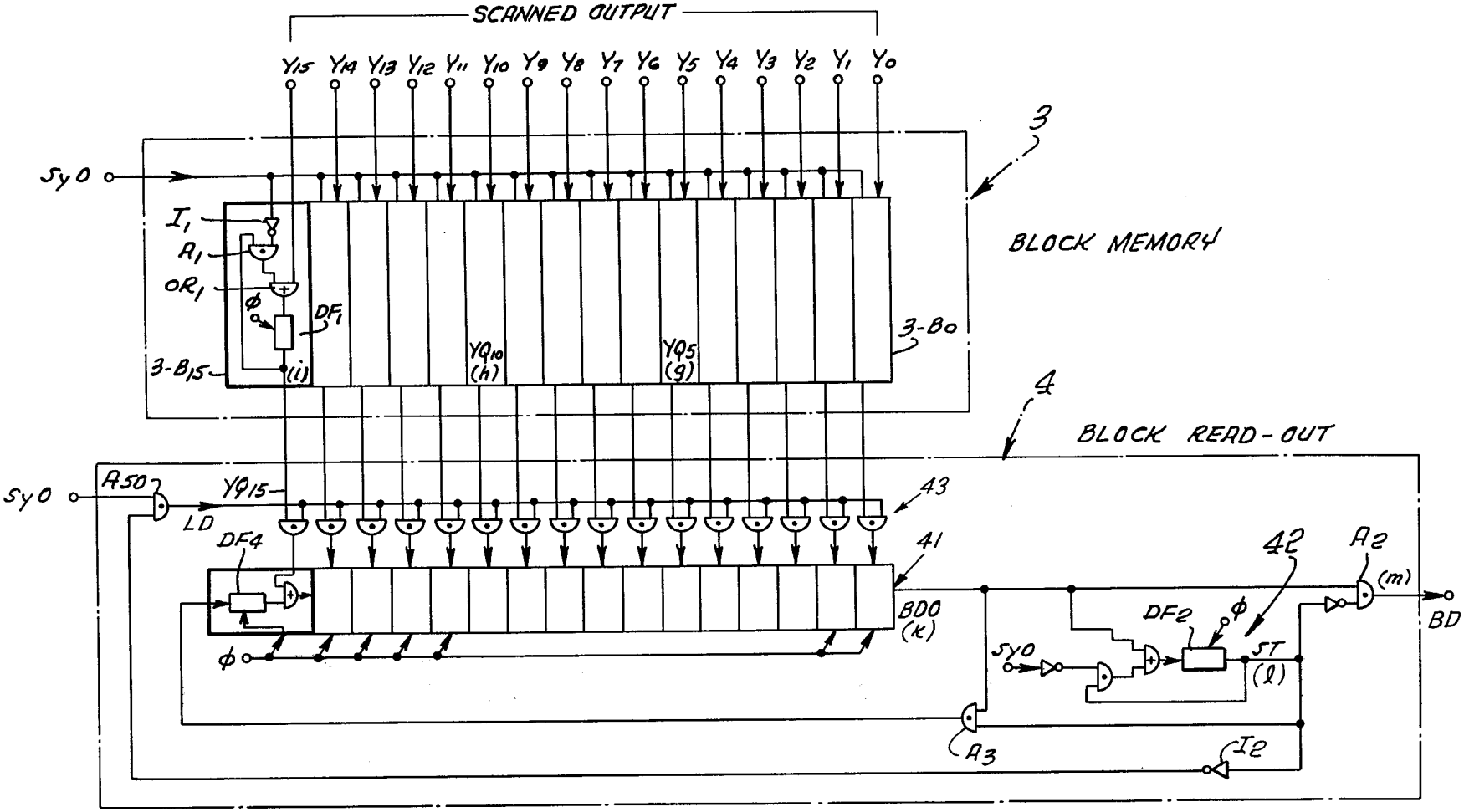
FIG. 4 is a circuit diagram showing specific examples of a block memory 3 and a block read-out unit 4 shown in FIG. 1.
Figure 5:
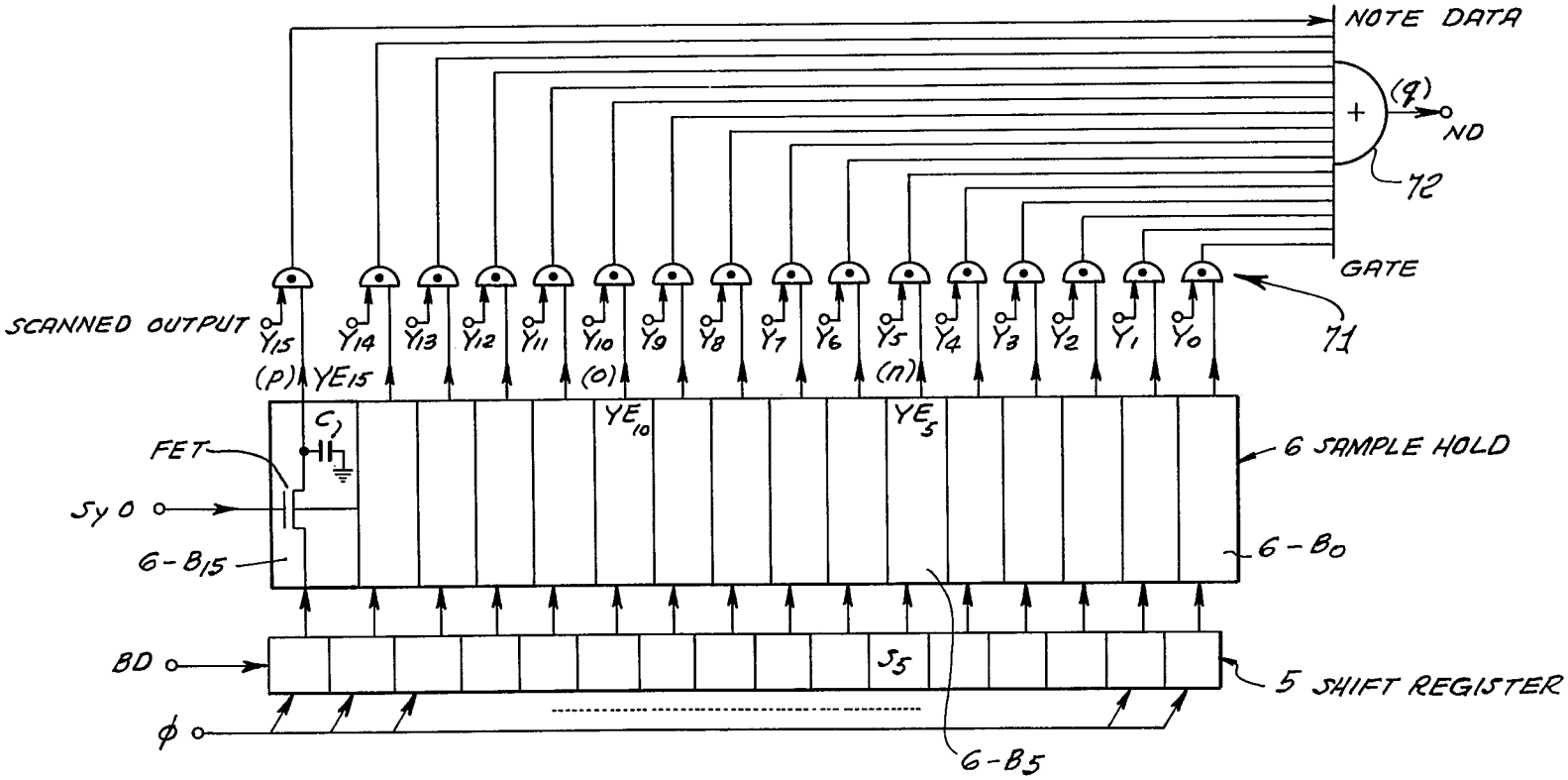
FIG. 5 is a circuit diagram showing specific examples of a shift register 5, a sample hold circuit 6 and a gate circuit 7.

Referring to FIG. 6, block data BD is applied to an input terminal $t_a$ from the AND circuit $A_2$ shown in FIG. 4, whereas note data ND is applied to an input terminal $t_b$ from the OR circuit 72 shown in FIG. 5. As will be apparent from FIG. 3, block data BD in a certain block time period constitute information representing a particular key name. More specifically, combinations of $B_5$ and $N_{11}$, $B_{10}$ and $N_3$. $B_{10}$ and $N_7$, $B_{10}$ and $N_{12}$, and $B_{15}$ and $N_3$ in FIG. 3 represent particular key names.

The key coder comprises a BD-ND to KC encoding circuitry receiving the block data BD and the note data ND and delivering key codes respectively corresponding to the BD-ND combinations.

In FIG. 6, a shift register 75 carries out shifting upon receipt of every clock pulse $\phi_0$ having a period of 1 $\mu$s thereby outputting a clock pulse $\phi$ every 12 $\mu$s from a NOR circuit 76. This clock pulse $\phi$ is used for the channel processor and the key coder as will be described later as well as for the above described key data generator.

The BD-ND to KC encoding circuitry includes a 4-bit binary counter 77 for counting the clock $\phi$. The overflow output of this counter 77 is a pulse having a period of 192 $\mu$s and is used as the synchronizing pulse SyO. The output of the counter 77 is applied to a delay circuit 80 which consists of asone-stage 4-bit shift register driven by the clock $\phi$. The output of the counter 77 is also applied to a gate circuit 78. The gate circuit 78 gates out the output of the counter 77 only upon receipt of the block data BD. Accordingly, a 4-bit code which has passed the gate circuit 78 has contents corresponding to the time slot of the block data BD. As to the block $B_5$, for example, a 4-bit code of 0101 is applied to a self-hold circuit 79. The self-hold circuit 79 which is of a construction similar to the self-hold circuit 3 – $B_0$ shown in FIG. 4 is provided for self-holding the 4-bit code signal. The self-hold circuit 79 holds in circulation the signal applied from the gate circuit 78 by the clock $\phi$, clearing the signal upon application of the synchronizing pulse SyO. The output of the self-hold circuit 79 is applied to a sample hold circuit 81. This sample hold circuit 81 supplies an output code BC* of the self-hold circuit 79 to an identity circuit 81 and also delays this code BC* by 12 $\mu$s (the delayed code is represented as BC) and supplies the delayed code BC to an entrance gate 89*a* of a key code memory 89. Accordingly, the sample hold circuit 81 continues to supply to the entrance gate 89*a* a particular block code BC corresponding to the block data BD applied to the input terminal $t_a$ during a block time period immediately following a block time period in which the first block data is applied to the input terminal $t_a$. The output code NC of the 12 $\mu$s delay circuit 80 represents a note code which sequentially changes its contents every 12 $\mu$s during application of a particular block code BC. The note code NC also is applied to the entrance gate 89*a*. A combination of the block code BC and the note code NC is hereinafter called a key code KC. As will be apparent from the foregoing description, the key code KC indicates all keys in a particular block in time sequence.

The note code NC* of the counter 77 is applied to an identity circuit 82 with the block code BC*. The note code NC* and the block code BC* are combined with each other to constitute a key code KC*. The above described key code KC is obtained by delaying the key code KC* by 12 $\mu$s. The key code KC therefore has the same contents as the key code KC* but is delayed in time by 12 $\mu$s.

The key code memory 89 consists of a shift register driven by the clock $\phi_o$ and including channels of a number equal to the maximum number of tones to be reproduced simultaneously (12 in the present example), each channel consisting of 8 bits. Return gate 89*b* and entrance gate 89*a* are inserted in the input side of the key code memory 89. When the return gate 89*b* is enabled (i.e. the signal RKC = 1), it causes the output of the key code memory 89 to return to the input side thereof, whereby the key codes stored in the respective channels of the key code memory are delivered out repetitively and in time-shared sequence. The entrance gate 89*b* is enabled when an entrance instruction IKC is applied thereto to gate the key code KC to an empty channel of the key code memory 89, as will be described in detail later.

The key codes stored in the key code memory 89 can be cleared by closing of the return gate 89*b* at a suitable time such, for example, as upon releasing of a key during attack time period, upon completion of decay and at resetting in an initial state.

The channel processor searches, for a period of 12 $\mu$s during which the note data ND is applied to the input terminal $t_b$, whether a key code corresponding to the block data BD and the note date ND coincide with any key code stored in the key code memory 89. If there is no coincidence of the key code and if there is at least one empty channel available in this 12 $\mu$s period, the channel processor privides an entrance instruction to the entrance gate 89*a* for causing key code KC corresponding to the block data BD and the note data ND to be stored only in a first available channel.

This operation will be described in detail hereinbelow. When the note data ND is applied, the note code NC* produced at this time represents a time slot of the note data ND, i.e. the particular note. Accordingly, the key code KC* produced at this time represents a key corresponding to the block data BD and the note data ND. A final stage output MKC of the key code memory 89 is applied to the identity circuit 82 every 1 $\mu$s. For a period of 12 $\mu$s during which the note data ND is applied, outputs of all of the channels of the key code memory 89 are applied to the identity circuit 82. The identity circuit 82 compares the key code KC* with the code output MKC and produces a coincidence signal EQ* ( = 1) if the they coincide with each other. This signal EQ* is applied to the self-hold circuit 83 and held therein. This signal thereafter is applied to a sample hold circuit 84 and sample-held therein. The sample hold circuit 84 produces a signal REG during a 12 $\mu$s period immediately after 12 $\mu$s time period in which the signal EQ* existed. This signal REG is inverted in an inverter 85 and thereafter applied to an AND circuit 86. The note data ND is delayed by a 12 $\mu$s delay circuit 87 and thereafter applied to the AND circuit 86 as a signal KD. The AND circuit 86 further receives the final-stage output MKC of the key code memory 89 through a NOR circuit 88. Since the inverter 85 produces an output 0 when the signal EQ* exists, the output of the AND circuit 86 is 0, i.e. no entrance instruction is delivered.

If there is not signal EQ* during application of the note data ND, the signal REG is not produced in the succeeding 12 $\mu$s period, so that an output 1 of the inverter 85 is applied to the AND circuit 86. The NOR circuit 88 is provided for detecting whether there is an empty channel in the key code memory 89. If there is an empty channel, all bits of the signal MKC are 0 and, accordingly, the output of the NOR circuit 88 is 1 only during 1 $\mu$s in which the empty channel is detected. This enables the AND circuit 86 to produce a signal 1 which in turn is applied to the entrance gate 89*a* as an entrance instruction IKC. This entrance instruction IKC is also applied to the sample hold circuit 84 and sample-held therein to produce the above described signal REG. The AND circuit 86 does not produce any entrance instruction during a period of time immediately after delivery of the entrance instruction IKC till generation of a next clock $\phi$. This arrangement is employed for causing the key code KC to be stored only in an empty channel which has first become available.

The code KC which is applied to the entrance gate 89*a* when the entrance instruction IKC is applied to the gate 89*a* is a key code corresponding to the particular block data BD and note date ND because KC is a code obtained by delaying the key code KC* by 12 $\mu$s.

Operations of the channel processor when the block date $B_5$ and the note data $N_{11}$ are applied thereto will be described with reference to pulse waveshapes of signals appearing in the component parts of the channel processor shown in FIGS. 7 and 8.

The code NC*, i.e. the output of the counter 77, at the time when the block data $B_5$ shown in FIG. 7(*a*) is applied during a block time period $T_1$ is 0101 as shown in FIG. 7(*c*). This code NC* is applied to the self hold circuit 79 and thereafter is sample-held in the sample hold circuit 81. The output BC* of the sample hold circuit 81 during a next block time period $T_2$ therefore is 0101 as shown in FIG. 7(*e*). When the note data $N_{11}$ is applied to the terminal $t_b$ during the block time period $T_2$ as shown in FIG. 7(*b*) (the period of time during which the note data $N_{11}$ is applied hereinafter is represented by $t_{11}$). The output code NC* of the counter 77 is 1011(FIG. 7(*c*)). Accordingly, the code KC* applied to the identity circuit 82 during the period of time $t_{11}$ is 01011011. Since the code NC produced by the 12 μs delay circuit 80 and the code BC produced by the sample hold circuit 81 are codes obtained by delaying the codes NC* and BC* by 12 μs as shown by FIGS. 7(*d*) and 7(*f*), contents of the key code KC in a next period of time $t_{12}$ are 01011011. In the foregoing manner, the key coder can produce the code signals KC*, KC which have encoded time slots corresponding to the block data BD and the note date ND.

FIG. 7(*g*) shows the output KD of the 12 μs delay circuit 87. This output KD is obtained by delaying the note date ND by 12 μs. FIGS. 8(*a*) – 8(*k*) illustrate states of noe data ND, KD, key code KC*, output signal MKC of the key code memory 89, coincidence signal EQ* , signal REG and entrance instruction IKC during the 12 μs periods of time $t_{11}$ and $t_{12}$. In the following description, generation of the entrance instruction will be explained with reference to FIG. 8.

Assume that key codes as shown in FIG. 8(*d*) are stored in the first to the eleventh channels of the key code memory 89. In the illustrated case the key code 01011011 stored in the fourth channel of the key code memory 89 coincides with the KC* = 01011011. The identity circuit 82 therefore produces a coincidence signal EQ* as shown in FIG. 8(*e*). The coincidence signal EQ* is self-held in the self hold circuit 83 and thereafter is sample-held in the sample hold circuit 84 during the next period $t_{12}$, so that the signal REG shown in FIG. 8(*f*) is produced from the sample hold circuit 84. This signal REG is inverted by the inverter 85 and the inverted output 0 is applied to the AND circuit 86 with a result that no entrance instruction IKC is delivered to the entrance gate 89*a*. Alternatively stated, no key code KC* is allotted to an empty channel of the key code memory 89 notwithstanding the fact that the seventh to the twelfth channels of the key code memory 89 are empty because the key code coinciding with the key code KC* has already been stored in the fourth channel.

If the key codes as shown in FIG. 8(*h*) are stored in the respective channels of the key code memory 89, there exists no key code among them which coincides with the key code KC*. The identity circuit 82 therefore does not produce a coincidence signal EQ*. On the other hand, the NOR circuit 88 produces a signal 1 when a first empty channel (the seventh channel in the present example) is applied thereto. The AND circuit 86 thereupon produces an entrance instruction IKC shown in FIG. 8(*k*). This enables the entrance gate 83*a* of the key code memory 89 to gate the key code KC = 01011011 to the seventh channel of the memory. The entrance instruction IKC is also applied to the sample hold circuit 84 and sample-held therein, so that the signal REG as shown in FIG. 8(*j*) is produced during the period of time $t_k$. Accordingly, the entrance instuction IKC is not produced during this period of time $t_k$. This arrangement is employed for ensuring storage of a new key code in only one empty channel.

The operation of the key coder and the channel processor has been described with respect to the block data $B_5$ and the note data $N_{11}$. The key coder and the channel processor operates in the same manner with respect to all of the other block data and note data. As shown in FIG. 3, within the block time period $T_2$ in which the note data $N_{11}$ is applied, next block data $B_{10}$ is also applied. The application of the block data $B_{10}$, however, merely causes the self-hold circuit 79 to hold a corresponding counter output during the block time period $T_2$ without bringing any change in the waveshape states shown in FIG. 7. Accordingly, the operation of the channel processor with respect to the block data $B_5$ and the note data $N_{11}$ is not affected at all. Consequently, although the block data $B_5$, $B_{10}$, $B_{15}$ and the note data $N_{11}$, $N_3$, $N_7$, $N_{12}$, $N_3$ are successively applied to the key coder, the key code encoding operation of the key coder and the key code allotment operation of the channel processor are all completed within a period of time $T_1 + T_2 + T_3 + T_4$.

The foregoing description has been made with respect to a case wherein the key switch system according to the invention is incorporated in an electronic musical instrument. Fields in which the invention finds application is not limited to this but the inventive key switch system can be incorporated in other digital systems. If, for example, the inventive key switch system is incorported in an input unit of an electronic computer, ON-OFF information of key switches can be transferred to the computer with a small number of input lines and in a very short time. The channel processing portion of the inventive key switch system can also effectively be utilized for alloting randomly applied code signals to a memory having a particular number of channels.

What is claimed is:

1. Key switch system comprising:

a key time clock source;

a key switch matrix including a plurality of scanning lines, a plurality of output lines each constituting a block, and a plurality of key switches at respective intersections of said scanning lines and said output lines;

a scanner connected to scan said scanning lines sequentially and repetitively at a rate established by the key time clock, each complete scan of all scanning lines constituting a scanning cycle;

a block time clock source producing a block time signal at the end of each complete scanning cycle;

a block memory connected to said output lines and memorizing for each block any existence of a pulse in said output lines per scanning cycle, each such pulse representing a switch that is ON in said block;

block read-out means connected to said block memory and generating in one scanning cycle after another respective block data consisting of one pulse per scanning cycle, the time slot of said one pulse within said scanning cycle indicating the block which contains a key switch that is ON; and note data generating means connected to said block read-out means and to said output lines for taking out the scanned output as the note data of that block which was indicated by the block data in the preceding scanning cycle.

2. Key switch system as defined in claim 1 wherein said block read-out means comprises:

a shift register which receives at parallel input terminals thereof contents stored in said block memory in response to a block time signal;

means for causing said shift register to shift its contents sequentially with a cycle of circulation which coincides with said one scanning cycle;

a logic circuit connected to the output side of said shift register and delivering out only a first pulse among pulse outputs of said shift register as the block data; and sorting means including a feed-back circuit for feeding the rest of the pulse outputs of said shift register back to the input of said shift register.

3. Key switch system as defined in claim 1 wherein said note data generating means comprises a shift register connected to the output side of said block read-out means and sequentially shifting the block data by the key time clock only during the particular scanning cycle;

a plurality of sample hold circuits connected to respective stages of said shift register and holding the block data during an immediately following scanning cycle; and a plurality of gate circuits provided in correspondence to said sample hold circuits, each being connected at one of its input terminals to the output of its corresponding sample hold circuit and at another input terminal to a corresponding one of said output lines, said gate circuits taking out as the note data a scanned signal of the output line corresponding to the one block held in said sample hold circuit in said immediately following scanning cycle.

4. Key switch system as defined in claim 1 further comprising encoding means for receiving said block data and note data and thereupon producing a binary code signal consisting of a plurality of bits and representing said block data and said note data.

5. Key switch system as defined in claim 4 wherein said encoding means comprises:

a binary counter of a plurality of bits driven by the key time clock and delivering a signal NC* consisting of a plurality of bits and changing cyclically;

a key time delay circuit connected to said binary counter and delivering a signal NC which consists of a plurality of bits and has been delayed with respect to the signal NC* by one key time;

a gate connected to the output of said binary counter and passing the multiple-bit signal produced by said counter in response to the block data; and a self hold and sample hold circuit connected to said gate and delivering a signal BC* applied from said gate and a signal BC which has been delayed with respect to the signal BC* by one key time during a block time immediately following the block time period in which the applied block data exists;

a combination code KC* of the signal NC* and the signal BC* and a combination code KC of the signal NC and the signal BC respectively representing the key name of the particular key in the block.

6. Key switch system as defined in claim 5 further comprising:

a channel time clock sourse;

a key code memory driven by said channel time clock source and being capable of storing different key codes in and delivering them out of a plurality of channels; and a channel processor which causes the binary code signal delivered from said encoding means to be stored in an empty channel of said key code memory only when an identical binary code signal has not been stored in said key code memory.

7. Key switch system as defined in claim 6 wherein said channel processor comprises:

an identity circuit for detecting coincidence between the key code KC* and any of the key codes stored in the respective channels of said key code memory during the key time during which the note data is applied;

an empty channel detection circuit connected to the output of said key code memory and detecting existence of an empty channel in said key code memory;

a self hold and sample hold circuit for holding a coincidence signal produced from said coincidence circuit during one succeeding key time;

a delay circuit for delaying the note data by one key time;

a logic circuit connected to the outputs of said self hold and sample hold circuit, empty channel detection circuit and delay circuit and, if no coincidence has been detected, delivering the empty channel detection signal from said empty channel detection circuit to only one empty channel of said key code memory as an entrance instruction signal in said succeeding key time; and an entrance gate circuit for passing, upon receipt of said entrance instruction signal, said key code to the sole empty channel of said key code memory.

* * * * *